United States Patent [19]

Alexander et al.

[11] 4,401,490

[45] Aug. 30, 1983

[54] MELT EXPLOSIVE COMPOSITION

[76] Inventors: Roger D. Alexander, 15 Ripper St., Montmorency, Victoria, 3052; Andrew J. Bates, 30 Bank St., Ascot Vale, Victoria, 3032, both of Australia

[21] Appl. No.: 447,135

[22] Filed: Dec. 6, 1982

[30] Foreign Application Priority Data

Dec. 18, 1981 [AU] Australia ..... PF2017

[51] Int. Cl.[3] ..... C06B 45/00

[52] U.S. Cl. ..... 149/2; 149/21; 149/40; 149/41; 149/42; 149/43; 149/44; 149/46; 149/60; 149/61; 149/70; 149/76; 149/83; 149/85

[58] Field of Search ..... 149/2, 21, 40, 41, 42, 149/43, 44, 46, 60, 61, 70, 76, 83, 85

[56] References Cited

U.S. PATENT DOCUMENTS 4,248,644 2/1981 Healy ..... 149/2

*Primary Examiner*—Stephen J. Lechert, Jr.

*Attorney, Agent, or Firm*—Cushman, Darby & Cushman

[57] ABSTRACT

This invention concerns a melt explosive composition which comprises at least one oxygen-releasing salt, for example ammonium nitrate, at least one melt soluble fuel material, for example urea, and at least one naphthalenesulfonate derivative selected from the condensates of formaldehyde and naphthalenesulfonic acids and the alkali and alkaline earth metal salts thereof, for example disodium methylene-bis(naphthalene-$\beta$-sulfonic acid). The explosive compositions show a considerable improvement in detonation sensitivity in small diameter boreholes.

31 Claims, No Drawings

MELT EXPLOSIVE COMPOSITION

This invention relates to explosive compositions and in particular to melt explosive compositions comprising an oxygen-releasing salt, a melt soluble fuel and a formaldehyde-naphthalenesulfonate condensate.

Solid and/or cast melt explosive compositions comprising as a major constituent an oxygen-releasing salt such as ammonium nitrate have been known for many years. However, while such compositions are in many aspects satisfactory as explosives they suffer from the disadvantage that it has been found difficult in practice to load them into boreholes at commercially acceptable loading rates to give the packing density and homogeneity required to achieve the desired blast energy.

In order to overcome these deficiencies of solid melt explosive compositions it has been proposed to use water bearing explosive compositions which in general terms comprise a mixture of an oxygen-releasing salt material, fuel material and water in proportions such that the compositions are pourable or pumpable. These compositions, often referred to as slurry explosives or water-gel explosives, have proved very useful but they suffer from the disadvantage that the water content required to make the composition pourable or pumpable acts as a diluent which contributes little to the energy which becomes available when the composition is detonated.

More recently the use of low melting point melt explosive compositions has been proposed in order to provide a pourable or pumpable explosive composition which is not diluted by an appreciable amount of water. In U.S. Pat. Nos. 3,926,696 and 3,996,078 there are described explosive compositions comprising eutectic mixtures which are characterized in that they have solidification points below +10° C. and preferably below −10° C. However, each of the compositions disclosed in these patents comprises as a sensitizer a highly explosive, hazardous chemical such as a nitrate or a perchlorate salt of an amine or an alkanolamine.

In U.S. Pat. No. 4,134,780 there is disclosed a relatively low melting point melt explosive composition which is pourable, pumpable or flowable and which overcomes the disadvantage of using a highly explosive, hazardous chemical as a sensitizer. While the explosive compositions which are taught in this patent are eminently suitable for many applications, and especially those applications in which a bulk explosive composition is required which can be mixed on site and transferred to a borehole, they suffer from the disadvantage that they are not sufficiently sensitive to ensure reliable detonation in small diameter boreholes.

It has now been found that the incorporation of certain formaldehyde-naphthalenesulfonate condensates into melt explosive compositions comprising an oxygen-releasing salt and a melt soluble fuel provides, it is believed through the modification of the crystal habit of at least a portion of the oxygen-releasing salt, a melt explosive composition of improved sensitivity.

Accordingly the present invention provides a melt explosive composition which comprises at least one oxygen-releasing salt, at least one melt-soluble fuel material and at least one naphthalenesulfonate derivative selected from condensates of formaldehyde and naphthalenesulfonic acids, condensates of formaldehyde and $C_1$ to $C_{10}$-(alkyl)naphthalenesulfonic acids and the alkali metal and alkaline earth metal salts thereof.

Suitable oxygen-releasing salts for use in the compositions of the present invention include the alkali and alkaline earth metal nitrates, chlorates and perchlorates, ammonium nitrate, ammonium chlorate, ammonium perchlorate and mixtures thereof. The preferred oxygen-releasing salts include ammonium nitrate, sodium nitrate and calcium nitrate. More preferably the oxygen-releasing salt comprises ammonium nitrate or a mixture of ammonium nitrate and sodium nitrate.

Typically the oxygen-releasing salt component of the compositions of the present invention comprises from 50 to 90% and preferably from 70 to 85% by weight of the total composition. In compositions wherein the oxygen-releasing salt comprises a mixture of ammonium nitrate and sodium nitrate the preferred composition range for such a blend is from 5 to 25 parts of sodium nitrate for every 100 parts of ammonium nitrate. Therefore, in the preferred compositions of the present invention the oxygen-releasing salt component comprises from 70 to 85% by weight (of the total composition) ammonium nitrate or a mixture of from 5 to 20% by weight (of the total composition) sodium nitrate and from 50 to 80% by weight (of the total composition) ammonium nitrate.

The term "melt soluble fuel material" is used herein to mean a fuel material of which at least a part, and preferably all, is capable of forming a eutectic mixture with at least a part of the oxygen-releasing salt component, the melting point of the eutectic mixture being less than the melting point of either the fuel material or the oxygen releasing salt component. It is desirable that the melt soluble fuel material be capable of forming a miscible melt with ammonium nitrate since this component is a preferred oxygen releasing salt. Thus in the preferred compositions of the present invention, which contain ammonium nitrate, the melt soluble fuel material, hereinafter referred to as the primary fuel, may be defined as organic compounds which form an homogeneous eutectic melt with ammonium nitrate at temperatures up to 90° C. and which are capable of being oxidized by ammonium nitrate to gaseous products. The primary fuel may be a single compound or a mixture of two or more compounds. Suitable primary fuels include carboxylates, thiocyanates, amines, imides or amides. Suitable examples of useful primary fuels include urea, ammonium acetate, ammonium formate, ammonium thiocyanate, hexamethylenetetramine, dicyandiamide, thiourea, acetamide and mixtures thereof. Urea is a preferred primary fuel.

Typically, the primary fuel component of the compositions of the present invention comprises from 7 to 30% and preferably from 10 to 25% by weight of the total composition.

The naphthalene-sulfonate derivatives which have been found to provide the improved sensitivity explosive compositions of the present invention are condensates of formaldehyde and naphthalenesulfonic acids and $C_1$ to $C_{10}$-(alkyl)naphthalenesulfonic acids and the alkali and alkaline earth metal salts thereof, hereinafter referred to as formaldehyde-naphthalenesulfonate condensates. Examples of such formaldehyde-naphthalenesulfonate condensates include sulfonates in which two, three or more naphthalenesulfonate or alkylnaphthalenesulfonate nuclei are joined together by methylene groups in what amounts to a low-degree condensation polymer. Preferred naphthalenesulfonate derivatives include alkali metal salts of condensates of formaldehyde and naphthalenesulfonic acids such as, for example, alkali metal salts of methylenebis(naphthalene-β-sulfonate).

It is not necessary to incorporate more than 2% by weight of the formaldehyde-naphthalenesulfonate condensate component in the explosive compositions of the present invention to achieve the desired improvement in sensitivity. However, while higher proportions of the formaldehyde-naphthalenesulfonate condensate component may be used, for reasons of economy it is desirable to keep the proportion of the formaldehyde-naphthalenesulfonate condensate to the minimum required to give the desired effect. Typically the formaldehyde naphthalenesulfonate condensate comprises from 0.01 to 5.0% by weight of the total composition and preferably from 0.1 to 2.0% by weight of the total composition.

The explosive compositions of the invention may comprise a melt which assumes a molten form at a temperature in the range of from −10° C. to +90° C. comprising at least one oxygen-releasing salt, at least one melt-soluble fuel material and at least one formaldehyde-naphthalenesulfonate condensate. Alternatively, the explosive compositions of the invention may comprise as a first component a melt which assumes a molten form at a temperature in the range of from −10° C. to +90° C. comprising at least one oxygen-releasing salt, at least one melt-soluble fuel material and at least one formaldehyde-naphthalenesulfonate condensate and as a second component a further amount of at least one oxygen-releasing salt.

In one preferred embodiment the present invention provides a melt explosive composition which is pourable, pumpable or flowable at a temperature in the range of from −10° C. to +90° C. and comprises at least one oxygen-releasing salt, at least one melt-soluble fuel material and at least one naphthalenesulfonate derivative selected from condensates of formaldehyde and naphthalenesulfonate acids, condensates of formaldehyde and $C_1$ to $C_6$-(alkyl)naphthalenesulfonic acids and the alkali metal and alkaline earth metal salts thereof.

If desired other optional fuel materials, referred to hereinafter as secondary fuel materials, may be incorporated into the compositions of the present invention. Suitable secondary fuel materials may be chosen from a range of materials including carbonaceous materials. Preferably such carbonaceous materials are solids such as, for example, comminuted coke or charcoal, carbon black; resin acids such as abietic acid or derivatives thereof; sugars such as sucrose or dextrose; and other vegetable products such as starch, nut meal or wood pulp. Other types of suitable secondary fuel materials which may be incorporated into the compositions of the present invention include finely divided elements such as sulfur, silicon and aluminium. Preferred secondary fuel materials include aluminium powder.

Typically, the optional secondary fuel component of the compositions of the present invention comprises from 0 to 10% by weight of the total composition.

If desired the compositions of the present invention may also comprise a thickening agent which optionally may be crosslinked. The thickening agents, when used in the compositions of the present invention, are suitably polymeric materials, especially gum materials typified by the galactomannan gums such as locust bean gum or guar gum or derivatives thereof such as hydroxypropyl guar gum. Other useful, but less preferred, gums are the so-called biopolymeric gums such as the heteropolysaccharides prepared by the microbial transformation of carbohydrate material, for example the treatment of glucose with a plant pathogen of the genux Xanthomonas typified by *Xanthomonas campestris.* Other useful thickening agents include synthetic polymeric materials and in particular synthetic polymeric materials which are derived, at least in part, from the monomer acrylamide.

Typically, the optional thickening agent component of the compositions of the present invention comprises from 0 to 2% by weight of the total composition.

As indicated above, when used in the compositions of the present invention, the thickening agent optionally may be crosslinked. It is convenient for this purpose to use conventional crosslinking agents such as zinc chromate or a dichromate either as a separate entity or as a component of a conventional redox system such as, for example, a mixture of potassium dichromate and potassium antimony tartrate.

Typically, the optional crosslinking agent component of the compositions of the present invention comprises from 0 to 0.5% and preferably from 0 to 0.1% by weight of the total composition.

In many instances it has been found that the successful use of thickening agents in the compositions of the present invention does not require the presence of water. However, if it is considered desirable to enhance the performance of the thickening agents or their crosslinking small amounts of water or a water-bearing medium may be incorporated into the compositions of the invention.

The explosive compositions of the present invention may also comprise a discontinuous gaseous phase as a means of controlling their density and sensitivity. The gaseous phase may be incorporated into the compositions of the present invention in the form of hollow particles, often referred to as microballoons, porous particles, or as gas bubbles homogeneously dispersed throughout the composition. Examples of suitable hollow particles include phenolformaldehyde, urea-formaldehyde and glass hollow microspheres. Examples of porous particles include expanded perlite.

Gas bubbles may be incorporated into the compositions of the invention by mechanical agitation, injection or bubbling the gas through the composition, or by in situ generation of the gas by chemical means. Suitable chemicals for the in situ generation of gas bubbles include peroxides such as, for example, hydrogen peroxide, nitrites such as, for example, sodium nitrite, nitrosoamines such as, for example, N,N'-dinitrosopentamethylenetetramine, alkali metal borohydrides such as, for example, sodium borohydride, and carbonates such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent.

By the incorporation of the appropriate volume of discontinuous gaseous phase compositions of the present invention may be made which have densities as low as 0.30 g/cc. Very low density compositions may be of particular utility when a low explosive energy/volume explosive is required such as, for example, when minimal backbreak is required during open pit blasting.

The explosive compositions of the present invention which incorporate gas bubbles, and particularly pumpable explosive compositions of the invention which incorporate gas bubbles, are liable to density increase and desensitization because of gas bubble disengagement on standing for any length of time in a molten or fluid state, and particularly during pumping. Therefore, the explosive compositions of the present invention which incorporate gas bubbles preferably also include a foam stabilizing surfactant of the type described in Australian patent application No. 68,707/81. Preferred foam stabilizing surfactants include primary fatty amines such as, for example, $C_6$ to $C_{22}$ alkylmines, $C_6$ to $C_{22}$ alkenylamines and mixtures thereof, and their ethoxylate derivatives.

In those explosive compositions of the present invention which incorporate gas bubbles and a foam stabilizing surfactant it is not necessary to add more than 2.0% w/w of foam stabilizing surfactant to the compositions to achieve the desired foam stabilizing effect. While higher proportions of surfactant will stabilize the foam, for reasons of economy it is desirable to keep the proportion of the foam stabilizing surfactant to the minimum required to have the desired effect. The preferred level of foam stabilizing surfactant is in the range of from 0.3 to 1.5% by weight of the total composition.

In a further aspect the invention provides a process for the manufacture of a melt explosive composition which comprises at least one oxygen-releasing salt, at least one melt-soluble fuel material and at least one naphthalenesulfonate derivative selected from condensates of formaldehyde and naphthalenesulfonic acids, condensates of formaldehyde and $C_1$ to $C_{10}$-(alkyl)-naphthalenesulfonic acids and the alkali metal and alkaline earth metal salts thereof which process comprises forming a melt comprising the melt-soluble fuel, the naphthalenesulfonate derivative and at least a portion of the oxygen-releasing salt at a temperature in the range of from −10° C. to +90° C. and incorporating into said melt any remaining portion of the oxygen-releasing salt.

In the preparation of the preferred melt explosive compositions of the present invention which comprise oxygen-releasing salts such as, for example, ammonium nitrate and sodium nitrate, a melt soluble fuel such as, for example, urea, a formaldehyde-naphthalenesulfonate condensate such as, for example, disodium methylenebis(naphthalene-β-sulfonate), a thickening agent such as, for example, guar gum, a crosslinking agent such as, for example, sodium dichromate, a secondary fuel material such as, for example, aluminium, gas bubbles, and a foam-stabilizing surfactant such as, for example, octadecylamine, it is preferred to prepare a melt comprising porition of the oxygen-releasing salt, the melt soluble fuel, the formaldehyde-naphthalenesulfonate condensate and the thickening agent, to add to this melt the remainder of the oxygen releasing salt, the secondary fuel, and the cross-linking agent, and to introduce the gas bubbles either by the incorporation of an in situ chemical gassing agent or by mechanical aeration.

The temperature at which the mixture of the oxgyen-releasing salt, the melt-soluble fuel material and the naphthalenesulfonate derivative forms a melt will vary dependent to some extent on the nature of the components and their proportions used to make the melt. As hereinbefore indicated the temperature at which the melt is formed lies in the range of from −10° C. to +90° C. By judicious choice of the components and their proportions it is possible to form melts having a wide range of melt-formation temperatures. For example, a mixture of 5 parts by weight of urea, 3 parts by weight of ammonium acetate, 2 parts by weight of acetamide and 10 parts by weight of ammonium nitrate will form a melt when heated to a temperature of 35° C. A mixture of ammonium nitrate, urea, ammonium acetate and ammonium formate in a weight ratio of 8:6:3:3 is fluid at a temperature of −10° C. while the same components in a weight ratio of 9:6:2:3 are liquid at a temperature of 20° C. Mixtures of ammonium nitrate, sodium nitrate and urea in a weight ratio of 468:97:435 have a melting point of about 35° C. and such mixtures are illustrative of melts comprising a single melt soluble fuel material. In the interests of safety and ecomony it is preferred to utilize melts which can be formed by heating at a temperature not in excess of 70° C.

Those melt explosive compositions of the present invention in which the major proportion of the composition, and preferably from 60 to 100% by weight of the composition, comprises a melt which assumes a molten form at a temperature in the range of from −10° C. to +90° C. are eminently suitable for use in conjunction with conventional pumping or mixing trucks designed for use with known water based explosives of the so-called aqueous slurry type. For example, the thicekend melt component of such a composition of the present invention may be placed in the solution tank of such a conventional mixing truck and the residual components of the composition may be added to and mixed with the melt in a conventional manner and the resulting composition of the present invention may be transferred to a borehole ready for detonation. Such compositions of the present invention are also useful as fillings for explosive cartridges and therefore may be utilized as packaged explosives.

Those melt explosive compositions of the present invention in which a substantial proportion of the composition, and typically from 30 to 90% by weight of the composition, comprises as a second component a further amount of at least one oxygen-releasing salt may be loaded into boreholes by pouring, by using an auger or by other conventional techniques known in the art. Such explosive compositions of the present invention may also be used as fillings for explosive cartridges and therefore may be utilized as packaged explosives.

The melt explosive compositions of the present invention, which comprise a formaldehyde-naphthalenesulfonate condensate, show a significant improvement in sensitivity over prior art melt explosive compositions which do not contain such a naphthalenesulfonate derivative. For example, a melt explosive composition of the invention comprising ammonium nitrate and sodium nitrate as oxygen-releasing salts, urea as a melt soluble fuel, aluminium powder as a secondary fuel and disodium methylene-bis(naphthalene-β-sulfonate) as formaldehyde-naphthalenesulfonate condensate could be detonated at charge diameters as low as 43 millimeters using a 100 g pentolite booster whereas a melt explosive composition not of the present invention comprising the same components, with the exception that it did not contain the formaldehyde-naphthalenesulfonate condensate, failed to detonate at a charge diameter of 63 millimeters using the same size booster charge.

The reason for the improved sensitivity and hence smaller critical charge diameter of the explosive compositions of the present invention is not completely understood. However, while the theory should in no way be regarded as limiting, it is believed that the formaldehyde-naphthalenesulfonate condensates may modify the crystal habit of at least a portion of the oxygen-releasing salt.

It is well known in the art to use so-called crystal habit modifiers in the formulation of aqueous blasting compositions. For example, U.S. Pat. No. 3,397,097 discloses the use of crystal habit modifiers in aqueous-gel explosive compositions to induce the oxygen-releasing salt to crystallize from aqueous solution in crystals of smaller particle size and larger specific surface to provide an explosive composition of greatly enhanced sensitivity.

In contrast to aqueous-gel explosive compositions in which the oxygen-releasing salt crystallizes from aqueous solution, in melt explosive compositions the oxygen-releasing salt crystallizes from the melt. Therefore, perhaps it is not surprising to find that crystal habit modifiers such as abietic acid, sodium lauryl sulfate and sodium methylnaphthalenesulfonate, which are all known and used to enhance the sensitivity of aqueous-gel explosive compositions, are not effective in enhancing the sensitivity of melt explosive compositions. However, this makes all the more surprising the completely unexpected finding of the present invention. That is, that an enhancement of sensitivity similar to that obtained by the use of a crystal habit modifier in aqueous-gel compositions in which the oxygen-releasing salt crystallizes from water, can be obtained by the use of formaldehyde-naphthalenesulfonate condensates in melt explosive compositions in which the oxygen-releasing salt crystallizes from the melt.

The invention is now illustrated by, but is not limited to, the following Examples in which all parts and percentages are expressed on a weight basis unless otherwise specified

EXAMPLE 1

Into an insulated vessel fitted with stirring means and heating means and connected to a pumping and delivery means there was added ammonium nitrate (582 parts), sodium nitrate (111 parts), urea (262 parts), water (30 parts), acetic acid (2.5 parts), thiourea (0.1 parts), octadecylamine (3.9 parts) and disodium methylene-bis(-naphthalene-β-sulfonate) (5 parts). The contents of the vessel were stirred and melted by heating. Heating of the melt was continued to a temperature of 65° C. and guar gum (3.5 parts) was stirred into the melt to provide a thickened melt. Stirring of the thickened melt was continued and then there was added thereto ammonium nitrate prills (380 parts), sodium nitrite (1.5 parts as a 33.3% w/w aqueous solution), sodium dichromate (0.9 parts as a 50% aqueous solution) and aluminium powder (88.2 parts). On completion of the mixing, samples of the slurry were pumped by the pumping means through the delivery means to a series of simulated cylindrical boreholes in the form of cylindrical cardboard tubes having internal diameters of 75, 63, 50 and 43 millimeters. The slurry in each tube was allowed to cool to form a solid and an attempt was made to detonate the explosive composition in each tube using a 100 g pentolite booster. The explosive compositions having charge diameters of 75, 63, 50 and 43 millimeters each gave complete detonation.

COMPARATIVE EXAMPLES 1-7

In order to demonstrate the improved sensitivity of the explosive compositions of the invention, explosive compositions not of the invention were prepared following the procedure described in Example 1 but either excluding the formaldehyde-naphthalenesulfonate condensate or substituting for the formaldehyde-naphthalenesulfonate condensate use in the explosive compositions of the invention an additive reported to modify the crystal habit of ammonium nitrate in aqueous slurry explosive compositions. The proportions of the ingredients were the same as those described in Example 1 and the results of attempts to detonate samples of the compositions at specific charge diameters, in cardboard tubes, using a 100 g pentolite booster are reported in Table 1 below.

TABLE 1

| Comparative Example No | Additive | Charge Diameter (mm) | Result of Attempt to Detonate |
|---|---|---|---|
| 1 | abietic acid | 63 | failed; partial detonation only |
| 2 | sodium lauryl sulfate | 63 | failed; partial detonation only |
| 3 | sodium methyl-naphthalene sulfonate | 75 | failed; partial detonation only |
| 4 | sodium methyl-naphthalene-sulfonate | 63 | failed; partial detonation only |
| 5 | none | 63 | failed; partial detonation only |
| 6 | none | 50 | failed; partial detonation only |
| 7 | none | 43 | failed; no detonation |

EXAMPLE 2

Into an insulated vessel fitted with stirring means and heating means and connected to a pumping and delivery means there was added ammonium nitrate (582 parts), sodium nitrate (111 parts), urea (260 parts), water (30 parts), glacial acetic acid (4 parts), thiourea (0.2 parts), "Armeen" HT (4 parts; "Armeen" is a Trade Mark and "Armeen" HT is a primary fatty amine) and disodium methylenebis(naphthalene-β-sulfonate) (5 parts). The contents of the vessel were stirred and melted by heating. Heating of the melt was continued to a temperature of 65° C. and guar gum (3.5 parts) was stirred into the melt which was then allowed to stand at a temperature of 65° C. for two hours to provide a thickened melt.

Portion (760 parts) of the thickened melt prepared as described above was transferred to a planetary mixer and ammonium nitrate prills (239.5 parts), sodium nitrite (1.0 part of a 33.3% w/w aqueous solution) and sodium dichromate (0.6 parts of a 50% aqueous solution) were mixed into the melt. On completion of the mixing a sample of the melt explosive composition of the invention was poured into a simultated borehole in the form of a cylindrical cardboard tube having an internal diameter of 75 mm. After cooling the sample had a density of 1.15 g/cm$^3$. After storage for a period of one week the sample gave complete detonation (bubble energy yield 1.16 MJ/kg) when detonated using a 140 g pentolite booster.

COMPARATIVE EXAMPLE 8

A melt explosive composition not of the invention was prepared following the procedure described in Example 2 with the exception that the disodium methylene-bis(naphthalene-β-sulfonate) was omitted from the mixture. A sample was prepared in a 75 mm diameter cylindrical cardboard tube and after cooling the sample had a density of 1.15 g/cm$^3$. After storage for a period of one week an attempt to detonate the sample using a 140 g pentolite booster gave only partial detonation (bubble energy yield 0.46 MJ/kg).

EXAMPLE 3

A thickened melt was prepared following the procedure described in Example 2 but using the following proportions of ingredients.

| Component | Parts by Weight |
|---|---|
| ammonium nitrate | 582 |
| sodium nitrate | 111 |
| urea | 262 |
| water | 30 |
| glacial acetic acid | 2.5 |
| thiourea | 0.1 |
| "Armeen" HT | 3.9 |
| disodium methylene-bis(naphthalene-β-sulfonate) | 5.0 |
| guar gum | 3.5 |

A melt explosive composition of the invention was prepared by mixing the following proportions of ingredients into portion (680 parts) of the above melt, in a planetary mixer.

| Component | Parts by Weight |
|---|---|
| ammonium nitrate prills | 258.4 |
| aluminium powder (fuel grade) | 60.0 |
| sodium nitrite (33.3% w/w aqueous solution) | 1.0 |
| sodium dichromate (50% w/w aqueous solution) | 0.6 |

On completion of the mixing samples of the composition were poured into a series of simulated boreholes in the form of cylindrical cardboard tubes having internal diameters of 140, 75, 63, 50 and 43 millimeters. The composition in each tube was allowed to cool to form a solid and an attempt was made to detonate the explosive composition in each tube using a 140 g pentolite booster. The samples having charge diameters of 140, 75, 63, 50 and 43 mm each gave complete detonation with bubble energy yields of 2.17, 1.95, 1.95, 1.86 and 1.77 MJ/kg respectively.

COMPARATIVE EXAMPLE 9

A melt explosive composition not of the invention was prepared following the procedure described in Example 3 with the exception that the disodium methylenebis(naphthalene-β-sulfonate) was omitted from the mixture. Samples were prepared in cylindrical cardboard tubes having diameters of 63, 59 and 43 millimeters. An attempt was made to detonate each sample using a 140 g pentolite booster. Each sample either failed to detonate or gave only partial detonation.

COMPARATIVE EXAMPLES 10 TO 12

Melt explosive compositions not of the invention were prepared following the procedure described in Example 3 with the exception that the disodium methylenebis(naphthalene-β-sulfonate) was replaced with the same quantity of abietic acid, sodium laurylsulfate or sodium methylnaphthalenesulfonate. The results of attempts to detonate samples of the compositions at specific charge diameters, in cardboard tubes, using 140 g pentolite boosters are reported in Table 2 below.

TABLE 2

| Comparative Example No | Additive | Charge Diameter (mm) | Result of Attempt Detonate |
|---|---|---|---|
| 10 | abietic acid | 63 | failed; partial detonation only |
| 11 | sodium lauryl-sulfate | 63 | failed; partial detonation only |
| 12 | sodium methyl-naphthalene-sulfonate | 75 | failed; partial detonation only |
| 13 | sodium methyl-naphthalene-sulfonate | 63 | failed; partial detonation only |

EXAMPLE 4 TO 9

Melt explosive compositions of the invention were prepared following the procedure described in Example 3 with the amount of disodium methylenebis(naphthalene-β-sulfonate) in the melt component being varied between 2 and 20 parts by weight.

On completion of the mixing samples of each of the compositions were poured into simulated boreholes in the form of cylindrical cardboard tubes having an internal diameter of 50 mm. The composition in each tube was allowed to cool to form a solid and an attempt was made to detonate the explosive composition in each tube using a 140 g pentolite booster. The results are reported in Table 3 below.

TABLE 3

| Example No | Additive (parts by weight) | Result of Attempt to Detonate | Bubble Energy (MJ/kg) |
|---|---|---|---|
| 4 | 2 | complete detonation | 1.29 |
| 5 | 6 | complete detonation | 1.66 |
| 6 | 9 | complete detonation | 1.67 |
| 7 | 12 | complete detonation | 1.64 |
| 8 | 15 | complete detonation | 1.70 |
| 9 | 20 | complete detonation | 1.12 |

EXAMPLE 10

A thickened melt was prepared following the procedure described in Example 2 but using the following proportions of ingredients.

| Component | Parts by Weight |
|---|---|
| ammonium nitrate | 576 |
| sodium nitrate | 133 |
| urea | 245 |
| water | 30 |
| glacial acetic acid | 4.0 |
| thiourea | 0.2 |
| "Armeen" HT | 4.0 |
| disodium methylene-bis(naphthalene-β-sulfonate) | 5.0 |
| guar gum | 4.0 |

A melt explosive composition of the invention was prepared by mixing the following proportions of ingredients into portion (800 parts) of the above melt, in a planetary mixer.

| Component | Parts by Weight |
|---|---|
| ammonium nitrate | 138.4 |
| aluminium powder (fuel grade) | 60.0 |
| sodium nitrite (33.3% w/w | 1.0 |

-continued

| Component | Parts by Weight |
|---|---|
| aqueous solution) | |
| sodium dichromate (50% w/w aqueous solution) | 0.6 |

On completion of the mixing a sample of the composition was poured into a simulated borehole in the form of a thin walled steel cylinder having an internal diameter of 140 millimeters. The density of the composition after cooling was 1.25 g/cm$^3$. The sample gave complete detonation (bubble energy yield 1.76 MJ/kg) when detonated using a 140 g pentolite booster.

EXAMPLE 11

A melt explosive composition of the invention was prepared by mixing the following amounts of ingredients into 549 parts of thickened melt prepared as described in Example 10.

| Component | Parts by Weight |
|---|---|
| sodium nitrite (33% w/w aqueous solution) | 0.65 |
| sodium dichromate (50% w/w aqueous solution) | 0.35 |

On completion of the mixing a sample was poured into a simulated borehole in the form of a cylindrical cardboard tube having an internal diameter of 75 mm. The density of the composition after cooling was 1.2 g/cm$^3$. The sample was detonated using a 140 g pentolite booster.

COMPARATIVE EXAMPLE 14

A melt explosive composition not of the invention was prepared following the procedure described in Example 11 with the exception that the disodium methylenebis(naphthalene-$\beta$-sulfonate) was omitted. A sample was prepared in a cylindrical cardboard tube having a diameter of 85 mm. The density of the composition after cooling was 1.2 g/cm$^3$. An attempt to detonate the sample using a 140 g pentolite booster failed.

We claim:

1. A melt explosive composition comprising at least one oxygen-releasing salt, at least one melt soluble fuel material and at least one naphthalenesulfonate derivative selected from the condensates of formaldehyde and naphthalenesulfonic acids, condensates of formaldehyde and $C_1$ to $C_{10}$-(alkyl)naphthalenesulfonic acids, and the alkali metal and alkaline earth metal salts thereof.

2. A melt explosive composition according to claim 1 wherein said naphthalenesulfonate derivative is selected from the condensates of formaldehyde and naphthalenesulfonic acids and the condensates of formaldehyde and $C_1$ to $C_{10}$-(alkyl)naphthalenesulfonic acids in which two naphthalenesulfonate or $C_1$ to $C_{10}$-(alkyl)naphthalenesulfonate moieties are joined together by a methylene group, and the alkali metal and alkaline earth metal derivatives thereof.

3. A melt explosive composition according to claim 2 wherein said naphthalenesulfonate derivative is selected from the alkali metal salts of condensates of formaldehyde and naphthalenesulfonic acids.

4. A melt explosive composition according to claim 3 wherein said naphthalenesulfonic derivative comprises an alkali metal salt of methylenebis(naphthalene-$\beta$-sulfonate).

5. A melt explosive composition according to claim 1 wherein said oxygen releasing salt is selected from the group consisting of the alkali metal, the alkaline earth metal and the ammonium, nitrates, chlorates, perchlorates and mixtures thereof.

6. A melt explosive composition according to claim 5 wherein said oxygen releasing salt is selected from the group consisting of ammonium nitrate, sodium nitrate, calcium nitrate and mixtures thereof.

7. A melt explosive composition according to claim 6 wherein said oxygen releasing salt comprises a mixture of ammonium nitrate and sodium nitrate.

8. A melt explosive composition according to claim 1 wherein said melt soluble fuel material is selected from the group consisting of carboxylates, thiocyanates, amines, imides, amides and mixtures thereof.

9. A melt explosive composition according to claim 8 wherein said melt soluble fuel material is selected from the group consisting of urea, ammonium acetate, ammonium formate, ammonium thiocyanate, hexamethylenetetramine, dicyandiamide, thiourea, acetamide and mixtures thereof.

10. A melt explosive composition according to claim 9 wherein said melt soluble fuel material comprises urea.

11. A melt explosive composition according to claim 1 comprising an eutectic which melts at a temperature in the range from $-10°$ C. to $+90°$ C. and which comprises at least one oxygen-releasing salt, at least one melt soluble fuel material and at least one formaldehyde-naphthalenesulfonate derivative selected from the condensates of formaldehyde and naphthalenesulfonic acids, the condensates of formaldehyde and $C_1$ to $C_{10}$-(alkyl)naphthalenesulfonic acids, and the alkali metal and alkaline earth metal salts thereof.

12. A melt explosive composition according to claim 1 comprising: as a first component an eutectic which melts at a temperature in the range from $-10°$ C. to $+90°$ C. and which comprises at least one oxygen-releasing salt, at least one melt soluble fuel material and at least one formaldehyde-naphthalenesulfonate derivative selected from the condensates of formaldehyde and naphthalenesulfonic acids, the condensates of formaldehyde and $C_1$ to $C_{10}$-(alkyl)naphthalenesulfonic acids, and the alkali metal and alkaline earth metal salts thereof; and a second component which comprises a further amount of at least one oxygen-releasing salt.

13. A melt explosive composition according to claim 1 wherein said oxygen-releasing salt component comprises from 50 to 90% by weight of said composition.

14. A melt explosive composition according to claim 1 wherein said melt soluble fuel material comprises from 7 to 30% by weight of said composition.

15. A melt explosive composition according to claim 1 wherein said naphthalenesulfonate derivative comprises from 0.01 to 5.0% by weight of said composition.

16. A melt explosive composition accordng to claim 13 wherein said oxygen releasing salt component comprises from 70 to 85% by weight of said composition.

17. A melt explosive composition according to claim 14 wherein said melt soluble fuel material comprises from 10 to 25% by weight of said composition.

18. A melt explosive composition according to claim 15 wherein said naphthalenesulfonate derivative comprises form 0.1 to 2.0% by weight of said composition.

19. A melt explosive composition according to claim 12 wherein said first composition comprises at least 50% by weight of said composition.

20. A melt explosive composition according to claim 19 wherein said first component comprises at least 60% by weight of said composition.

21. A melt explosive composition according to claim 1 which further comprises up to 10% by weight of a secondary fuel material selected from the group consisting of carbonaceous materials and finely divided elements.

22. A melt explosive composition according to claim 21 wherein said secondary fuel is aluminium powder.

23. A melt explosive composition according to claim 1 which further comprises at least one thickening agent.

24. A melt explosive composition according to claim 23 wherein said thickening agent is crosslinked.

25. A melt explosive composition according to claim 1 which further comprises a discontinuous gaseous phase.

26. A melt explosive composition according to claim 25 wherein said discontinuous gaseous phase comprises gas bubbles.

27. A melt explosive composition according to claim 26 which further comprises a foam stabilizing surfactant to stabilize said gas bubbles.

28. A melt explosive composition comprising an eutectic which melts at a temperature in the range from −10° C. to +90° C. and which comprises at least one oxygen-releasing salt, at least one melt soluble fuel material, at least one formaldehyde-naphthalenesulfonate derivative selected from the condensates of formaldehyde and naphthalenesulfonic acids, the condensates of formaldehyde and $C_1$ to $C_{10}$-(alkyl)naphthalenesulfonic acids, and the alkali metal and alkaline earth metal salts thereof, a discontinuous gaseous phase comprising gas bubbles, a foam stabilizing surfactant to stabilize said gas bubbles, a thickening agent, and a crosslinking agent.

29. A melt explosive composition comprising: as a first component an eutectic which melts at a temperature in the range from −10° C. to +90° C. and which comprises at least one oxygen-releasing salt, at least one melt soluble fuel material, at least one formaldehyde-naphthalenesulfonate derivative selected from the condensates of formaldehyde and naphthalenesulfonic acids, the condensates of formaldehyde and $C_1$ to $C_{10}$-(alkyl)naphthalenesulfonic acids, and the alkali metal and alkaline earth metal salts thereof, a discontinuous gaseous phase comprising gas bubbles, and a foam stabilizing surfactant to stabilize said gas bubbles, a thickening agent, and a crosslinking agent; and a second component which comprises a further amount of at least one oxygen-releasing salt.

30. A melt explosive composition according to claim 29 wherein said second component further comprises up to 10% by weight, based on the total composition, of a secondary fuel material selected from the group consisting of carbonaceous materials and finely divided elements.

31. A process for the manufacture of a melt explosive composition which comprises at least one oxygen releasing salt, at least one melt soluble fuel material and at least one naphthalenesulfonate derivative selected from condensates of formaldehyde and naphthalenesulfonic acids, condensates of formaldehyde and $C_1$ to $C_{10}$-(alkyl)-naphthalenesulfonic acids and the alkali metal and alkaline earth metal salts thereof which process comprises forming a melt comprising the melt-soluble fuel, the naphthalenesulfonate derivative and at least a portion of the oxygen releasing salt at a temperature in the range of from −10° C. to +90° C. and incorporating into said melt any remaining portion of said oxygen releasing salt.

* * * * *